United States Patent [19]

Corica

[11] Patent Number: 4,601,079

[45] Date of Patent: Jul. 22, 1986

[54] PORTABLE BRIDGING APPARATUS

[76] Inventor: John A. Corica, 435 W. Elkhorn, Estes Park, Colo. 80517

[21] Appl. No.: 655,514

[22] Filed: Sep. 28, 1984

[51] Int. Cl.[4] ..... E01D 15/12

[52] U.S. Cl. ..... 14/2.4; 14/24; 182/41; 182/152

[58] Field of Search ..... 14/1, 2.4, 27; 404/35; 182/40, 41, 2, 152, 163; 405/220; 52/108

[56] References Cited

U.S. PATENT DOCUMENTS 3,314,200 4/1967 Schuster ..... 52/108

3,397,546 8/1968 Eisert et al. ..... 14/2.4

3,420,331 1/1969 Minnite ..... 14/27

4,417,424 11/1983 Jacobson ..... 182/41

*Primary Examiner*—James A. Leppink

*Assistant Examiner*—Matthew Smith

*Attorney, Agent or Firm*—Dean P. Edmundson

[57] ABSTRACT

Portable bridge apparatus is disclosed comprising a plurality of connected bridge segments. The bridge segments are adapted to be extended outward from a base to form a bridge and then can be retracted when the bridge is no longer needed. The apparatus is useful in rescue operations, among other uses.

14 Claims, 8 Drawing Figures

2
2
10
11
11A
11B
12
12A
13
14
15
16
17
18
20
26
28
29
30
34
38
40
48

PORTABLE BRIDGING APPARATUS

FIELD OF THE INVENTION

This invention relates to apparatus for bridging obstacles to enable humans to traverse from one location to another. More particularly, this invention relates to portable bridging apparatus which may be easily moved to any desired location where it may be needed.

BACKGROUND OF THE INVENTION

There are many common occasions when it is necessary to provide a safe temporary pathway for people to traverse form one position to another. For example, when there is a fire or toxic chemical spill in multi-story structures it is very often necessary to evacuate people from upper stories of the structure in order to remove them from actual or potential danger zones. Conventional metal fire escape stairs are not included on the exteriors of all multi-story buildings, and even when such stairs are present, it is not always safe to use them in order to pass floors where fires or chemical fumes are present. Furthermore, such stairs are not convenient to use when it is necessary to carry injured or weak persons who are unable to walk. Also, there are times when flooding creates conditions where people must be rescued from roof tops or upper level stories of buildings or from the opposite side of rivers, etc.

The disadvantages and limitations associated with other types of rescue equipment such as ladder trucks and helicopters include high cost and limited application. There has not heretofore been provided suitable apparatus for general and convenient use in rescue operations.

Although a roll-up pontoon bridge has been disclosed in U.S. Pat. No. 951,379, and a roll out dock has been disclosed in U.S. Pat. No. 3,397,546, such structures are not suitable for use in rescuing people from buildings, etc. The linkage bridge described in U.S. Pat. No. 4,024,595 includes link members coupled together. When the link members are rolled out from a reel they form a horizontal platform. To provide strength to the platform a reinforcement rod is passed lengthwise through eyelets on the underside of each link in the structure. There are no sides to the structure; there is only the linear floor.

SUMMARY OF THE PRESENT INVENTION

In accordance with the present invention there is provided a portable bridge apparatus which can be transported to any desired location (e.g., by being mounted on the bed of a truck or on a trailer) and then a bridge can be formed by extending outward a plurality of bridge segments which are connected together.

The portable bridge apparatus comprises:

(a) a plurality of bridge segments which are pivotably connected together, wherein each segment includes a floor portion and spaced apart wall portions;
(b) extension and retraction means;
(c) elevation means;
(d) a base member adapted to carry the extension and retraction means and the elevation means;
(e) tensioning means adapted to maintain the bridge segments in rigid arched alignment when in extended position.

The extension and retraction means is adapted to extend the bridge segments outward from the base in a manner such that an arched bridge is formed. The elevation means is adapted to raise or lower the outer end of the bridge. The extension and retraction means is further adapted to retract the bridge segments.

The portable bridge apparatus of this invention is a self-contained unit which may be carried on a truck bed or trailer or even a ship and transported very easily to any desired location. Because the apparatus is designed such that the bridge segments are pivoted relative to one another, the bridge segments may be rolled around a reel, for example. Accordingly, the apparatus does not occupy inordinate amounts of space, as compared to a ladder truck, for example.

Because the portage apparatus is a self-contained unit it can be operated without an outside power source, and it requires little or no maintenance. The bridge can be extended to any desired length (typically 50 to 100 feet). The apparatus does not require a large crew to transport or operate it. It can be used on land or water.

The apparatus is especially useful in the event of a disaster, such as a flood, fire, bridge destruction, major accident, etc. where it is necessary to evacuate people from a building or from one side of a road or river. The apparatus is also useful for transporting people safely across a busy roadway, e.g., for school children to cross the roadway. The apparatus may also be used as a temporary overpass for foot traffic during road or bridge construction.

The portable apparatus also has a very good strength-to-weight ratio. It may be very quickly deployed and does not require the use of any additional supports. The extended bridge may be raised or lowered to any height desired.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figures 1, 2, 2A, 3:
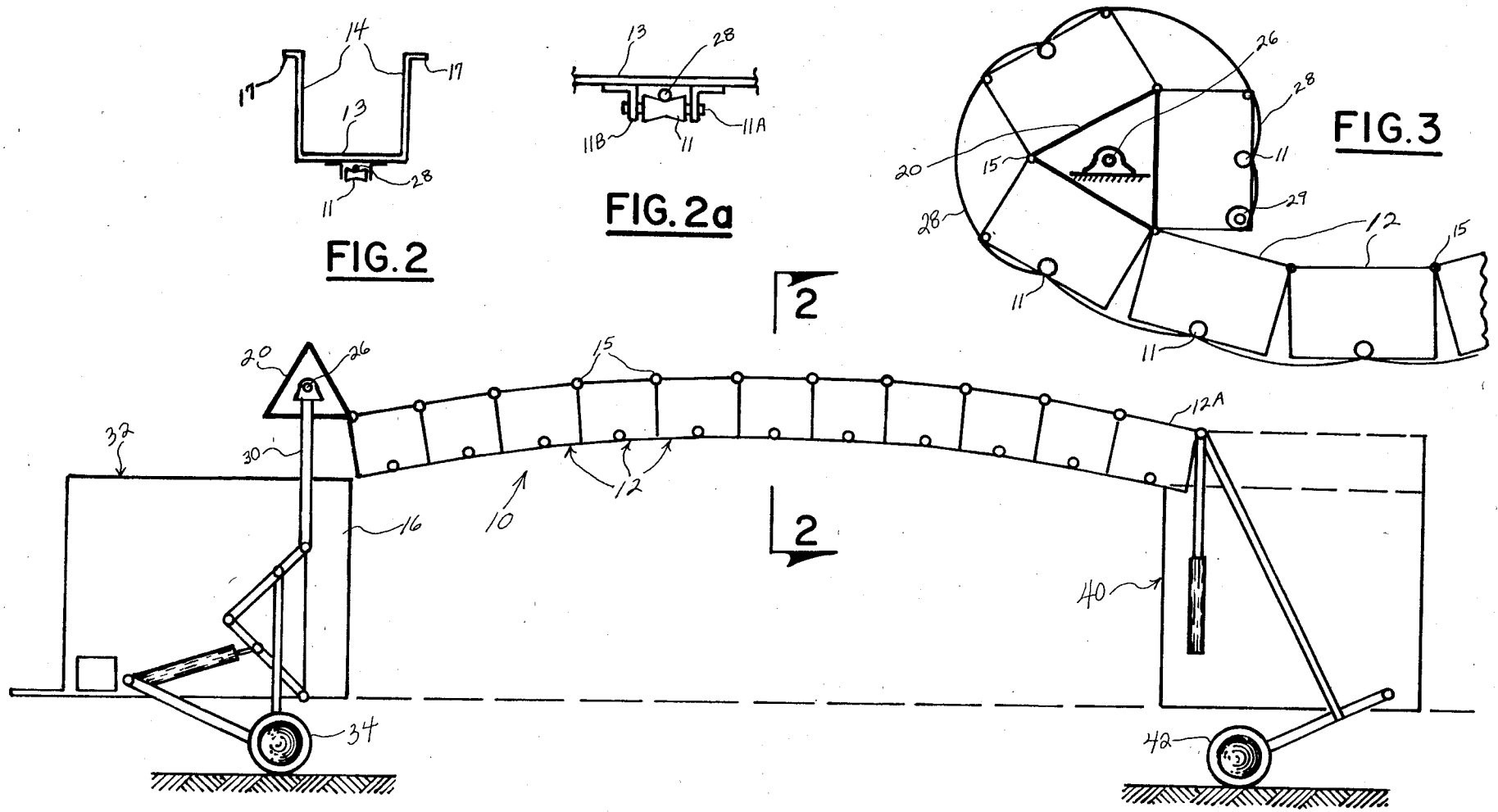
FIG. 1 is a side view of one embodiment of portable bridge apparatus of this invention.
FIG. 2 is a cross-sectional view along line 2—2 of the bridge apparatus shown in FIG. 1.
FIG. 2*a* is a front view of the floor portion of a bridge segment shown in FIG. 2.
FIG. 3 is a side view illustrating one manner of retracting the bridge apparatus and storing the segments on a reel.

Thus, in the drawings there is illustrated one embodiment of portable bridge apparatus 10 which includes a plurality of bridge segments 12 which are connected to one another. In this embodiment the segments 12 are connected in end-to-end fashion and they are adapted to form an arch, as shown in FIG. 1, when they are extended outward from base member 16.

Each bridge segment includes a floor portion 13 and upstanding side walls 14 which are spaced apart, as shown in FIG. 2.

Figures 6, 7:
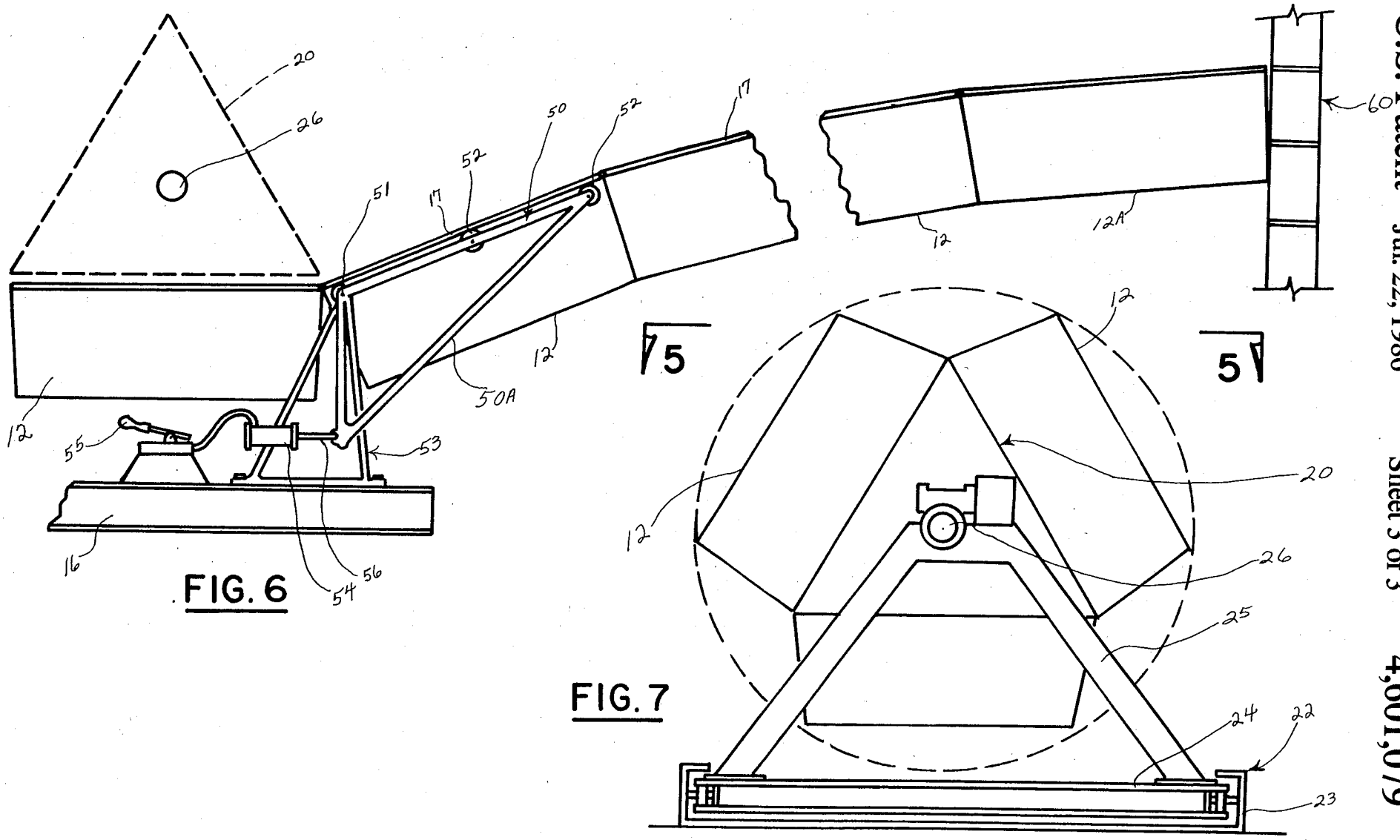
FIG. 6 illustrates one embodiment of elevation means useful in the present invention.
FIG. 7 is a side view illustrating one manner in which the bridge segments may be retracted and stored.

Bridge segments 12 are pivotably attached to each other at the top by means of pins 15. The bridge segments are not fastened to each other at their bottom edges. This arrangement enables the bridge segments to be rolled onto reel 20 for transport or storage (as illustrated in FIGS. 3 and 7).

Figure 5:
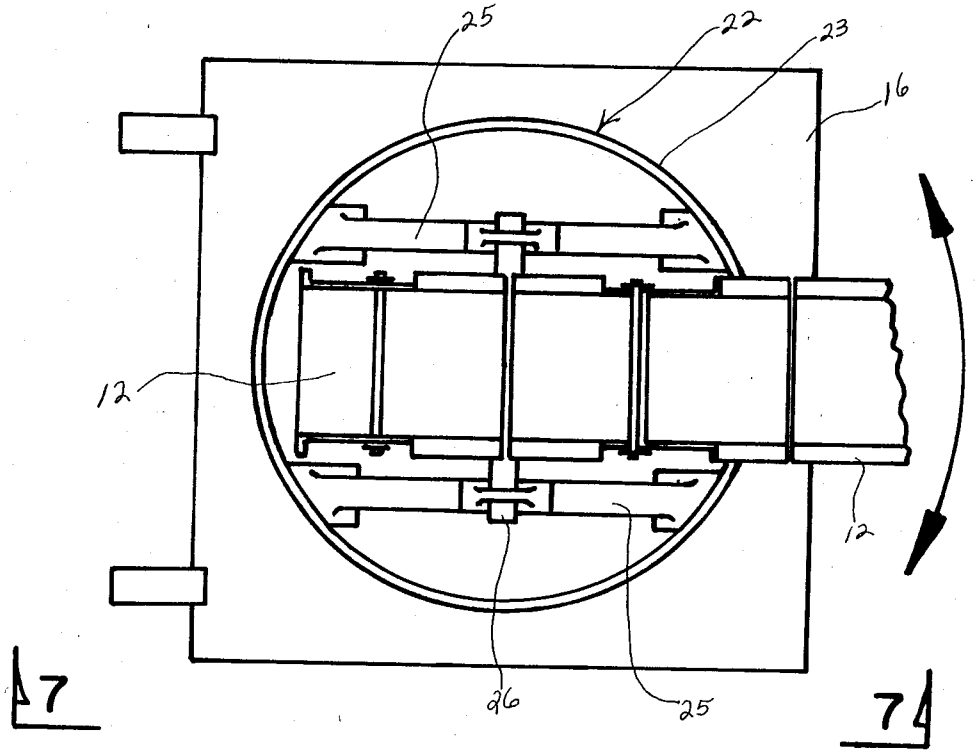
FIG. 5 is a top view of the base on which the portable bridge apparatus is mounted.

The base member 16 may be mounted on the bed of a truck or on a trailer or ship to facilitate transport to the desired location. If desired, the base may include a horizontal rotatable support 22 (shown in FIGS. 5 and 7) so that the bridge may be rotated in any desired direction by rotating the structure via the rotatable support.

The rotatable support mechanism 22 includes annular frame 23 within which is supported a horizontal table 24 which may rotate or pivot as desired relative to the frame 23. Upstanding brace members 25 support shaft 26 on which reel 20 is rotatably carried. The table 24 may be driven by a geared electric motor, if desired.

To provide rigidity and stability to the extended bridge structure tensioning means is provided which maintains an arch in the bridge. A preferred tensioning means comprises one or more elongated cables 28 which may be secured at one of its ends to the outermost bridge segment 12A and is secured at its innermost end on take-up roll 29.

The underside of each bridge segment includes rotatable pulley 11 supported on shaft 11A carried by brackets 11B. The cable 28 rides over pulley 11, e.g., as shown in FIGS. 2 and 2*a*, so that the cable is maintained in proper position at all times.

The take-up roll or drum 29 is adapted to take up slack in cable 28 when the bridge segments 12 are extended outwardly from reel 20. A torsion spring around the axis of the take-up roll 29 would keep the cable tight. Then additional tension may be applied to the cable by means of a hydraulic cylinder.

In order for the bridge segments to form on arch in extended position, the bottom of each segment has a length shorter than the top portion of each segment. Generally speaking, the length of each segment is in the range of about 6 to 10 feet long, with the bottom portion of each segment being about 2 to 6 inches shorter than the top portion. The width of the bridge segment is normally in the range of about 3 to 5 feet. The floor of each segment is typically 6 to 12 inches narrower than the top. This then enables the bridge segments to be nestable when rolled onto reel 20 so as not to occupy inordinate amounts of space. That is, as the bridge segments are wound onto reel 20, subsequent segments fit over and nest with previously wound segments.

The distance which the extended bridge is capable of spanning is dependent upon the number of bridge segments and the length of the segments. Generally speaking, the bridge is adapted to span distances of about 50 to 100 feet or more.

Preferably, the bridge segments are made of aluminum and fiberglass where strength and light weight are required.

They may also be made of carbon steel or stainless steel. The storage reel base member, and support members are preferably made of carbon steel.

The storage reel 20 is preferably a triangular frame, as shown, although it could have many more sides, if desired. It could even be circular. The reel may be constructed of angle or channel iron, for example. The reel may be driven by gearing a motor to the central shaft 26. The motor may be powered by the vehicle towing a bridge apparatus, or a generator may be included in order to supply the requisite power. A worm gear reduction may be used to reduce the speed of the reel shaft to approximately 6 rpm.

Figure 4:
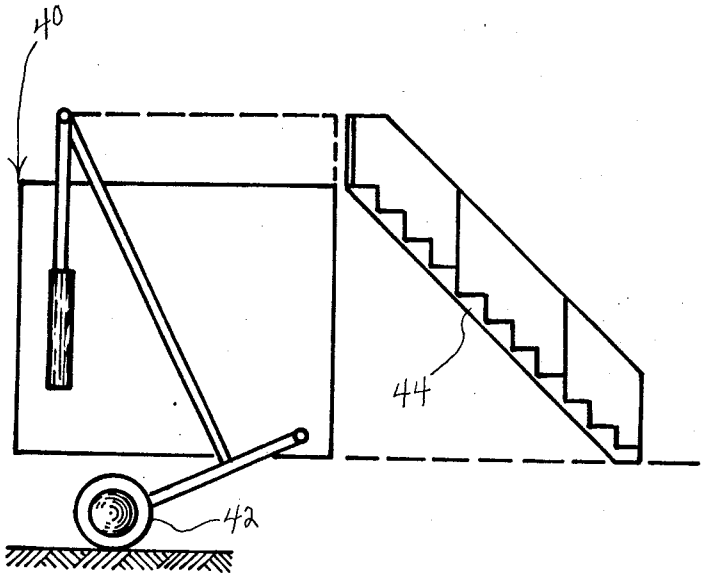
FIG. 4 illustrates one type of free end support which may be used in conjunction with the portable apparatus of the invention, if desired.

The reel 20 shown in FIG. 1 is supported by upstanding arms 30. The entire apparatus may be mounted on a trailer 32 having wheels 34 to enable the trailer to be towed to any desired location.

Where the apparatus of the invention is to be used to span a busy roadway, for example, the outer end 12A of the apparatus may extend to a separate platform 40 (e.g., which is positioned on the opposite side of the roadway). For this purpose the platform 40 includes steps 44 for pedestrians to return to street level, e.g., as illustrated in FIG. 4. Platform 40 may include wheels 42 to facilitate its transport to the desired location.

In FIG. 6 there is illustrated the elevation means for raising or lowering the height of the extended bridge apparatus. In this figure the elevation means comprises two arms 50 (one on each side of the bridge segments) which project outwardly from base 16 a distance approximately equal to the length of a bridge segment 12. It may, of course, project outwardly a further distance, if desired. Rotatable pulleys or wheels 52 carried by arms 50 provide a support surface for the flanges 17 along the top edges of bridge segments 12.

Pin 51 in frame structure 53 provides a pivotable support for the rear or inner end of arm 50. Hydraulic cylinder 54 (actuated by movement of handle 55) moves ram 56 outward or inward, as desired, to cause brace member 50A to urge arm 52 either upward or downward. This action thus determines the angle at which the bridge segments 12 leave the reel 20 and, accordingly, determines the height of the outermost bridge segment 12A may be positioned at any desired height adjacent wall 60 (e.g., when rescuing people from a burning building).

FIG. 6 also illustrates another feature of the invention pertaining to the length of the bridge segments. When the reel is three-sided, as shown, the innermost three bridge segments have a length approximately equal to the distance along one of the sides of the reel. The next three bridge segments have a length which is slightly longer so that such segments are positioned parallel to the respective sides of the reel as the segments are nested over the first three segments on the reel.

To further enhance the utility of the portable bridge apparatus in rescuing people from a very tall burning building, a catch basket may be connected to the outermost bridge segment for people to jump into from floors which are higher than the bridge apparatus is able to reach. For example, the catch basket may be cone-shaped and may include an inflatable pad or cushion therein to break the fall of people jumping into it.

Other variants are possible without departing from the present invention.

What is claimed is:

1. Portable bridge apparatus comprising;

(a) a plurality of bridge segments which are pivotably connected to one another; wherein each said segment includes a floor portion and spaced apart wall portions; wherein said segments are pivotably connected to one another at the tops of said wall portions; and wherein the length of said segment is shorter at said floor portion than at said tops of said wall portions;

(b) extension and retraction means comprising a rotatable reel adapted to support said bridge segments;

(c) elevation means carried by said base member;

(d) a base member adapted to carry said extension and retraction means and said elevation means;

(e) tensioning means, carried by said base member, which is adapted to maintain said bridge segments in rigid arched alignment when in extended position;

wherein said extension and retraction means is adapted to extend said bridge segments outward from said base in a manner such that an arched bridge is formed; wherein said elevation means is adapted to retract said bridge segments.

2. Portable bridge apparatus in accordance with claim 1, wherein said floor portion of each said bridge segment has a width which is narrower than the width at the top of said segment, wherein said bridge segments are adapted to nestably engage when rolled upon said reel.

3. Portable bridge apparatus in accordance with claim 1, wherein said base member is adapted to rotate in a horizontal plane.

4. Portable bridge apparatus in accordance with claim 1, wherein said tensioning means comprises a cable.

5. Portable bridge apparatus in accordance with claim 1, wherein each said bridge segment is connected to an adjacent said segment at its lower end.

6. Portable bridge apparatus in accordance with claim 1, wherein said elevation means comprises (a) an outwardly projecting arm which is pivotably supported by said base member, (b) a hydraulic cylinder adapted to pivot said projecting arm, and (c) actuating means for actuating said hydraulic cylinder.

7. Portable bridge apparatus in accordance with claim 1, wherein said apparatus is mounted on a trailer.

8. Portable bridge apparatus in accordance with claim 1, wherein said apparatus is mounted on a truck bed.

9. Portable bridge apparatus in accordance with claim 1, further comprising catch means adapted to be carried by the outermost bridge segment.

10. Portable bridge apparatus in accordance with claim 9, wherein said catch means comprises an inflatable pad disposed within a basket.

11. Portable bridge apparatus in accordance with claim 10, wherein said basket is cone-shaped.

12. Portable bridge apparatus in accordance with claim 1, wherein each said bridge segment has a length in the range of about 6 to 10 feet.

13. Portable bridge apparatus in accordance with claim 1, wherein the width of each bridge segment is in the range of about 3 to 5 feet.

14. Portable apparatus in accordance with claim 1, wherein the length of each bridge segment is about 2 to 6 inches shorter at the bottom than the top thereof.

* * * * *